US011572256B2

(12) United States Patent
Cambruzzi et al.

(10) Patent No.: US 11,572,256 B2
(45) Date of Patent: *Feb. 7, 2023

(54) MOUNTING SYSTEM FOR PERFORMING AN INSTALLATION OPERATION IN AN ELEVATOR SHAFT OF AN ELEVATOR SYSTEM

(71) Applicant: Inventio AG, Hergiswil (CH)

(72) Inventors: Andrea Cambruzzi, Zurich (CH); Erich Bütler, Ebikon (CH); Philipp Zimmerli, Harkingen (CH); Raphael Bitzi, Lucerne (CH)

(73) Assignee: INVENTIO AG, Hergiswil (CH)

( * ) Notice: Subject to any disclaimer, the term of this patent is extended or adjusted under 35 U.S.C. 154(b) by 624 days.

This patent is subject to a terminal disclaimer.

(21) Appl. No.: 16/481,123

(22) PCT Filed: Mar. 2, 2018

(86) PCT No.: PCT/EP2018/055189

§ 371 (c)(1),
(2) Date: Jul. 26, 2019

(87) PCT Pub. No.: WO2018/162350

PCT Pub. Date: Sep. 13, 2018

(65) Prior Publication Data

US 2021/0130136 A1 May 6, 2021

(30) Foreign Application Priority Data

Mar. 6, 2017 (EP) ..... 17159435

(51) Int. Cl.
*B66B 19/00* (2006.01)

(52) U.S. Cl.
CPC ..... *B66B 19/00* (2013.01)

(58) Field of Classification Search
CPC ..... B66B 19/00; B66B 11/0206; B66B 19/04; B66B 19/002; B66B 19/005; B66B 19/007; B66B 19/02
See application file for complete search history.

(56) References Cited

U.S. PATENT DOCUMENTS

2010/0018811 A1 1/2010 Vaudo et al.
2011/0272215 A1* 11/2011 Ach ..... B66B 11/04 187/254

FOREIGN PATENT DOCUMENTS

CA 2987484 A1 2/2017
CN 101528582 A 9/2009
(Continued)

*Primary Examiner* — Diem M Tran
(74) *Attorney, Agent, or Firm* — William J. Clemens; Shumaker, Loop & Kendrick, LLP

(57) ABSTRACT

A mounting system has a mounting device with a carrier component and a mechatronic installation component, a displacement component arranged above the mounting device in an elevator shaft and a support member connected between the carrier component and the displacement component. The displacement component displaces the mounting device in the shaft using the support member, wherein the carrier component is supported by an upper support roller on a support wall of the shaft during the displacement in the shaft. The support member generates a diagonal pull perpendicular to the support wall surface. The mounting system also has a compensating element that counteracts a tilting of the carrier component about the upper supporting roller perpendicular to the support wall during the displacement in the shaft.

17 Claims, 6 Drawing Sheets

(56) References Cited

FOREIGN PATENT DOCUMENTS

| | | | | | |
|---|---|---|---|---|---|
| CN | 102264624 | A | | 11/2011 | |
| CN | 104444700 | A | | 3/2015 | |
| EP | 0402148 | A1 | | 12/1990 | |
| JP | 2002187680 | A | * | 7/2002 | |
| JP | 2004331268 | A | * | 11/2004 | ..... B66B 7/046 |
| JP | 2002187680 | A | | 7/2007 | |
| JP | 2009196790 | A | | 9/2009 | |
| WO | WO-2007027172 | A1 | * | 3/2007 | ..... B66B 19/005 |
| WO | 2015102525 | A1 | | 7/2015 | |
| WO | 2017016783 | A1 | | 2/2017 | |

* cited by examiner

MOUNTING SYSTEM FOR PERFORMING AN INSTALLATION OPERATION IN AN ELEVATOR SHAFT OF AN ELEVATOR SYSTEM

FIELD

The invention relates to a mounting system for carrying out an installation operation in an elevator shaft of an elevator system.

BACKGROUND

WO 2017/016783 A1 describes a mounting system for carrying out an installation operation in an elevator shaft of an elevator system. The mounting system has: a mounting device comprising a carrier component and a mechatronic installation component in the form of an industrial robot; a displacement component arranged above the mounting device in the elevator shaft; and a support means, designed for example as a rope or chain, which is at least indirectly fixed to the carrier component. The displacement component can displace the carrier component and thus the mounting device in the elevator shaft by means of the support means, it being possible for the carrier component to be supported by means of an upper support roller on a support wall of the elevator shaft at least during a displacement in the elevator shaft. In the mounting system described in WO 2017/016783 A1, it is not ensured that the carrier component is in fact always supported by means of the upper support roller on the support wall during a displacement in the elevator shaft. This can thus lead to the mounting device swinging and, in extreme cases, striking the elevator shaft during a displacement.

WO 2015/102525 A1 describes a device for lining a mine shaft with concrete, which device can be lowered into the mine shaft while being retained by a support means. The mine shaft is mainly vertical, but has portions which are inclined with respect to the vertical. The device has variable support elements by means of which it can be supported against shaft walls of the mine shaft. The support is such that the support means always extends vertically.

SUMMARY

In contrast, it is in particular an object of the invention to propose a mounting system which can be displaced without risk of damage to the mounting system or to shaft walls in an elevator shaft. This object is achieved according to the invention by a mounting system having the features described below.

The mounting system according to the invention has: a mounting device comprising a carrier component and a mechatronic installation component; a displacement component arranged above the mounting device in the elevator shaft; and a support means or support member which is at least indirectly fixed to the carrier component. The displacement component can displace the carrier component and thus the mounting device in the elevator shaft by means of the support means, it being possible for the carrier component to be supported by means of an upper support roller on a support wall of the elevator shaft at least during a displacement in the elevator shaft.

According to the invention, the support means of the mounting system has a diagonal pull with respect to the vertical in the direction of the support wall of the elevator shaft. The carrier component is supported only on the support wall and not also on a wall opposite the support wall.

A diagonal pull of the support means is understood in this context to mean that the support means does not extend exactly vertically downward, but extends so as to be inclined with respect to the vertical, and a diagonal pull in the direction of the support wall of the elevator shaft is understood to mean here that the support means extends so as to be inclined in the direction of the support wall such that it is at a shorter distance from the support wall in the region of the displacement component than in the region of the connection to the carrier component. A distance of the support means in the region of the displacement component with respect to a vertical line through the connection of the support means to the carrier component is for example between 20 and 60 cm, in particular between 35 and 52 cm. In a vertical distance between the displacement component and the carrier component of 100 m, this results in a diagonal pull of between approximately 0.115° and 0.344°, in particular between approximately 0.2° and 0.3°, for example. The support means may also have a diagonal pull in a different direction. Here, the angle with respect to the vertical is a measure of the diagonal pull, and the diagonal pull is thus greater the greater said angle is. Said angle is at most 15°, for example. A retaining force which acts on the carrier component via the support means and is introduced into the carrier component at a force introduction point thus has not only a vertical component, but also a horizontal component in the direction of the support wall. The carrier component is thus not only retained by the support means in the vertical direction, but also pulled in the direction of the support wall such that the upper support roller is always in contact with the support wall.

Providing said diagonal pull of the support means makes it possible to reliably prevent the upper support roller lifting off from the support wall, and thus to prevent free hanging and swinging of the carrier component and thus the mounting device. The mounting device striking a shaft wall and the mounting device and/or the shaft walls thus being damaged is therefore also prevented. The mounting system according to the invention thus ensures safe and damage-free displacement of the mounting device in the elevator shaft.

In addition, the mounting system according to the invention has a compensating element which is designed and arranged such that, during a displacement of the carrier component in the elevator shaft, it counteracts tilting of the carrier component about the upper support roller in the direction of the support wall.

Said horizontal component of the retaining force in the direction of the support wall causes a torque about the upper support roller. If this torque is too great, the carrier component can tilt about the upper support roller in the direction of the support wall, the upper part of the carrier component rotating in the direction of the support wall and a distance between the lower region and the support wall thus becoming greater. In the case of such tilting of the carrier component, there is in turn the risk of the mounting device striking a shaft wall and thus the risk of the mounting device and/or the elevator shaft being damaged.

Said horizontal component of the retaining force and thus the torque about the upper support roller is mainly dependent on the diagonal pull in the direction of the support wall and becomes greater in particular as the diagonal pull becomes greater. Without a suitable countermeasure, the diagonal pull of the support means in the direction of the shaft wall changes during a displacement of the carrier component. Without a suitable countermeasure, the pull and thus the horizontal component of the retaining force in the direction of the support wall, as well as the torque about the upper support roller, become greater, i.e. increase, as a first distance between the displacement component and the carrier component or mounting device reduces. The compensating element of the mounting system can counteract the tilting of the carrier component about the upper support roller in various ways, which will be described in connection with the further embodiments of the invention.

Thus, the combination of the diagonal pull of the support means with respect to the vertical in the direction of the support wall and the compensating element during a displacement of the mounting device in the elevator shaft prevents both the upper support roller and thus the carrier component lifting off from the support wall, as well as the carrier component tilting about the upper support roller in the direction of the support wall, both of which can lead to the mounting device striking a shaft wall of the elevator shaft.

The installation component of the mounting device is retained on the carrier component and is designed to perform a mounting step as part of the installation operation at least partly automatically, preferably fully automatically. Said component is intended to be mechatronic, i.e. it is intended to have interacting mechanical, electronic and information-technology elements or modules.

The mounting device can in particular be designed in accordance with a mounting device described in WO 2017/016783 A1.

The feature whereby the displacement component is arranged above the mounting device in the elevator shaft relates to a functional state of the mounting system. In this state, the mounting system is mounted in an elevator shaft such that the carrier component and thus the mounting device can be displaced in the elevator shaft. The displacement component can be arranged in the elevator shaft or above the elevator shaft.

The displacement component may for example be designed as a kind of cable winch, whereby the support means can be wound, for example in the form of a flexible cable or chain, on a winch driven for example by an electric motor.

In particular, the carrier component has a pair of upper support rollers which are arranged next to one another in the horizontal direction in the functional state of the mounting system. In addition to the upper support roller(s), the carrier component also has in particular one lower or a pair of lower support rollers by means of which the carrier component is additionally supported in the elevator shaft on the support wall of the elevator shaft at least during a displacement. In the above-mentioned functional state of the mounting system, the lower support rollers are arranged below the upper support rollers. When the carrier component tilts about the upper support roller in the direction of the support wall, the lower support rollers lift off from the support wall.

The support wall on which the carrier component is supported during a displacement in the elevator shaft is one of the usually four existing shaft walls of the elevator shaft. An additional support wall is therefore not required. In particular the shaft wall opposite the door openings for shaft doors of the elevator system is selected as the support wall. The mounting system can therefore also be used when a plurality of elevator shafts that are not separated by shaft walls are arranged next to one another.

In particular, a device for measuring the elevator shaft, for example based on a laser scanner or one or more 3D cameras, can also be arranged on the carrier component. Said device can be displaced together with the carrier component in the elevator shaft and can measure the elevator shaft. Based on said measurements, for example a digital model of the elevator shaft can be created.

In one embodiment of the invention, the compensating element is designed and arranged such that it counteracts an increase in the diagonal pull of the support means when a first distance between the displacement component and the mounting device reduces. Since, as described above, the transverse force acting on the carrier component increases in the direction of the support wall as the diagonal pull becomes greater, an at least less pronounced increase in the diagonal pull counteracts an increase in the transverse force and thus an increase in the torque about the upper support roller. Tilting of the carrier component and thus of the mounting device when the first distance between the displacement component and the mounting device reduces, i.e. when the mounting device is pulled up in the elevator shaft, is thus effectively prevented. Said less pronounced increase in the diagonal pull refers to a course of the diagonal pull which would result in a mounting system without a compensating element. Compared with a pull at the beginning of a pull-up, the diagonal pull can remain the same during the pull-up, increasing only slightly or even becoming smaller.

In one embodiment of the invention, the compensating element is arranged with the displacement component and designed such that it increases a second distance between the support means in the region of the displacement component and the support wall when the first distance between the displacement component and the mounting device reduces. The increase in the second distance counteracts the increase in the diagonal pull, which, as described above, leads at least to a less pronounced increase in the transverse force in the direction of the support wall. The arrangement of the compensating element with the displacement component is advantageous in that it does not have to be arranged on the carrier component and thus does not take up any space on the carrier component, and in particular does not increase the weight of the mounting device.

The displacement component is in particular arranged in or directly above the elevator shaft such that it can be moved in a direction perpendicular to the support wall. For this purpose, it may be guided on one or two rails, for example. Alternatively, it is also possible that the position of the displacement component is not changed and only the course of the support means in the region of the displacement component is changed, i.e. is diverted to a greater or lesser extent, for example. A deflection roller of which the distance from the support wall can be changed, for example, can be used to deflect or guide the support means.

In one embodiment of the invention, the compensating element is arranged on the carrier component and designed such that it reduces a third distance between a suspension element of the carrier component, by means of which the carrier component is connected to the support means, and the support wall when the first distance between the displacement component and the mounting device reduces. The suspension element is arranged so as to be movable relative to the carrier component, in particular in a direction perpendicular to the support wall. The reduction in the third distance counteracts the increase in the diagonal pull of the support means in the direction of the support wall, which, as described above, leads at least to a less pronounced increase in the transverse force in the direction of the support wall. Said suspension element is part of the carrier component and designed as an eyelet or a hook, for example. The carrier component has only exactly one suspension element. The support means is thus fixed directly to the carrier component. It is very easy to move the suspension element, meaning a simple and cost-effective implementation of a compensating element is possible.

In one embodiment of the invention, a suspension means is arranged between the support means and the carrier component. The support means and the suspension means are connected by means of a connecting element. The support means is thus fixed to the carrier component by means of the suspension means such that the support means is indirectly fixed to the carrier component. The compensating element is designed and arranged such that it reduces a fourth distance between the connecting element and the support wall when the first distance between the displacement component and the mounting device reduces. The position of the connecting element with respect to the suspension means is therefore changed. The reduction in the fourth distance counteracts the increase in the diagonal pull of the support means in the direction of the support wall, which, as described above, leads at least to a less pronounced increase in the transverse force in the direction of the support wall. The suspension means is designed for example as a cable loop which is fixed at both ends to the carrier component. Such a cable loop can also be referred to as a "hanger". The connecting element of the suspension means is designed for example as an eyelet which can be moved along the cable loop, and thus the distance between the eyelet and the support wall can be changed.

In one embodiment of the invention, the compensating element has at least one energy accumulator which acts on the displacement component, the deflection element or the suspension element with a force in a direction perpendicular to the support wall of the elevator shaft. The above-described horizontal component of the retaining force on the carrier component has to be supported by the displacement component or the deflection element or acts on the suspension element. The energy accumulator is arranged and designed such that a change in the horizontal component of the retaining force leads to a movement of the displacement component, the deflection element or the suspension element, which, as described above, counteracts an increase in the diagonal pull of the retaining means in the direction of the support wall. By a corresponding design of the energy accumulator, which can be implemented by means of calculations or simple experiments, a desired diagonal pull of the retaining means in the direction of the support wall can be achieved. The compensating element is thus very simple and can be implemented without actuatable actuators. It is thus very cost-effective and hardly prone to error.

The energy accumulator can be designed for example as a spring which acts on the displacement component, the deflection element or the suspension element in said direction. The energy accumulator may also be designed as an air or hydraulic accumulator, for example. It is also possible for an energy accumulator to be arranged in each case on opposite sides of the displacement component, the deflection element or the suspension element, and to apply a force from both sides.

In one embodiment of the invention, the compensating element has at least one actuator which is designed and arranged such that it can displace the displacement component, the deflection element, the suspension element or the connecting element in a direction perpendicular to the support wall of the elevator shaft. This allows precise setting of the distance between said components and the support wall, and thus precise setting of the diagonal pull of the support means relative to the support wall and thus the horizontal component of the transverse force in the direction of the support wall. Tilting of the carrier component about the upper support roller in the direction of the support wall can thus be reliably prevented.

The actuator can be designed for example electrically, hydraulically or pneumatically, and can have a movable actuating cylinder which is coupled to the displacement component, the deflection element, the suspension element or the connecting element. The mounting system in particular has a controller for actuating the actuator accordingly. In particular, said controller also actuates further actuators of the mounting system, such as the displacement component.

In particular, the mounting device has a fixing component by means of which the carrier component can be fixed inside the elevator shaft in the lateral direction, that is to say in the horizontal direction. Fixing in the lateral direction should be understood to mean that the carrier component together with the installation component attached thereto can not only be vertically moved to a position at a desired height inside the elevator shaft by means of the displacement component and the support means, but that the carrier component can be also be fixed in this position in the horizontal direction by means of the fixing component.

For this purpose, the fixing component may for example be designed to be laterally supported or press-fit against walls of the elevator shaft such that the carrier component can no longer move relative to the walls in the horizontal direction. For this purpose, the fixing component may for example have suitable supports, props, levers or similar.

If the mounting device is fixed in the elevator shaft by means of the fixing component, it no longer has to be retained by the support means. The support means is no longer loaded in this case and can additionally be relieved of load by the displacement component. In this state, the displacement component, the deflection element, the suspension element or the connecting element is not loaded either, and therefore they can be moved with little effort. The controller actuating said actuator is therefore in particular provided for actuating the actuator in order to displace the displacement component, the deflection element, the suspension element or the connecting element when the mounting device is fixed in the elevator shaft by means of the fixing component. A less powerful, and thus cost-effective, actuator is therefore sufficient.

The second, third or fourth distance is set in particular on the basis of the first distance between the displacement component and the mounting device or on the basis of an inclination of the carrier component. This always allows suitable setting of said distances, and thus suitable setting of the diagonal pull of the support means relative to the support wall and thus the horizontal component of the transverse force in the direction of the support wall. Tilting of the carrier component about the upper support roller in the direction of the support wall can thus be particularly reliably prevented.

The first distance and the inclination are measured directly or indirectly for this purpose. The first distance can be measured directly by means of a distance sensor, for example. It may also be measured indirectly by measuring the distance from a bottom of the elevator shaft or on the basis of a measured initial distance between the displacement component and the mounting device and the distance traveled by the mounting device. The distance traveled can be determined for example on the basis of a measurement of the rotation of a drive roller of the displacement component. The inclination can be measured for example directly by means of an inclination sensor on the carrier component. By measuring the distance between the carrier component, for example in a lower region of the carrier component, and the support wall, the inclination of the carrier component can also be indirectly measured.

In addition, for example a table in which the second, third or fourth distance to be set is stored on the basis of the current first distance or the current inclination of the carrier component is stored in the controller actuating the actuator. Said table can be determined by means of calculations or simple experiments. The second, third or fourth distance is thus set by means of open-loop control. It is also possible for the second, third or fourth distance to be set by means of closed-loop control. For example, a desired inclination of the carrier component can be set by a manipulated variable realized as a second, third or fourth distance.

In one embodiment of the invention, the compensating element is designed and arranged such that it increases a fifth distance between a center of gravity of the mounting device and the support wall when a first distance between the displacement component and the mounting device reduces. For this purpose, the compensating element in particular has an actuator which can move a compensating weight. By increasing the fifth distance between the center of gravity of the mounting device and the support wall, tilting of the carrier component about the upper support roller in the direction of the support wall can be prevented even when the horizontal component of the retaining force in the direction of the support wall becomes greater. Owing to said increase in the fifth distance, the torque generated by the weight of the mounting device about the upper support roller increases, which counteracts the torque acting counter thereto generated by the horizontal component of the retaining force in the direction of the support wall. The increase in the horizontal component of the retaining force in the direction of the support wall caused by a greater diagonal pull of the retaining means in the direction of the support wall can thus be compensated for.

In this embodiment of the mounting system, a small, lightweight and cost-effective actuator can be used for the compensating element since the compensating weight is not under load during a movement, and therefore can be moved with a very small actuating force.

The mounting system in particular has a controller for actuating the actuator accordingly. In particular, said controller also actuates further actuators of the mounting system, such as the displacement component.

In one embodiment of the invention, the mechatronic installation component is part of the compensating element, and the fifth distance is increased by means of a change in the position of the mechatronic installation component. Therefore, an additional compensating weight and additional actuator are not required, which allows for a particularly lightweight and cost-effective mounting device.

The mechatronic installation component can be designed for example as an industrial robot comprising a robot arm. Prior to a displacement of the mounting device, the robot arm is brought as close as possible to the support wall. During the displacement of the mounting device, i.e. during the reduction of said first distance, the robot arm is then moved further and further away from the support wall, thus also moving the center of gravity away from the support wall, and thereby increasing said fifth distance. In order to achieve the greatest possible displacement of the center of gravity of the mounting device, the industrial robot can incorporate additional parts, such as components to be mounted, before the displacement, and thus increase the weight moved during the displacement. The mounting system also has a controller which is provided for actuating the mechatronic installation component accordingly.

The fifth distance is set in particular on the basis of the first distance between the displacement component and the mounting device or on the basis of the inclination of the carrier component. Thus, suitable setting of the fifth distance is always possible along with suitable setting of the distance between the center of gravity of the mounting device and the support wall. Tilting of the carrier component about the upper support roller in the direction of the support wall can thus be particularly reliably prevented. The above statements apply accordingly with regard to the detection of the first distance and/or said inclination, as well as to the evaluation of the sizes.

In one embodiment of the invention, the compensating element has a force introduction point at which the retaining force applied by the displacement component on the support means is introduced into the carrier component, and has the upper support roller, the force introduction point being arranged at the same level as or below the upper support roller, in particular a rotational axis of the upper support roller. For this purpose, the upper support roller can be arranged for example on a spacer element that projects upward from the carrier component.

The compensating element is in this case not a separate component, but is composed of a combination of components of the carrier component which are arranged with respect to one another in a specific manner. The compensating element can thus be realized in a particularly cost-effective manner. The force introduction point is in particular the point at which a suspension element, for example in the form of a hook or an eyelet, on which the support means is suspended is fixed to the carrier component. The suspension element may also be part of or formed by the carrier component; for example, the suspension element can be designed as a through-opening in the carrier component, into which opening the support means can be suspended. In this case, the force introduction point is the point at which contact between the support means and the carrier component occurs. The suspension element can in particular also be considered to be part of the compensating element.

In the described arrangement of the force introduction point with respect to the upper support roller, the horizontal component of the retaining force in the direction of the support wall cannot lead to a torque about the upper support roller which is oriented such that the carrier component could tip in the direction of the support wall. In this way, tilting of the carrier device in the direction of the support wall can be avoided in a particularly simple and cost-effective manner. The arrangement of the force introduction point with respect to the upper support roller again relates to the above-mentioned functional state of the mounting system. The force introduction point is located at the above-mentioned suspension element when the support means and the carrier component are directly connected. If a suspension means is arranged between the support means and the carrier component, this results in at least two force introduction points, specifically at the connection points between the suspension element and the carrier component. These multiple force introduction points are usually on a level. If this is not the case, then all the force introduction points should be arranged at the same level as or below the upper support roller.

The compensating element having said arrangement of the force introduction point(s) with respect to the upper support roller can be combined with all other described embodiments of the compensating element.

The object set out above is also achieved by a method for carrying out an installation operation in an elevator shaft of an elevator system comprising a mounting system. The mounting system used has

- a mounting device having a carrier component and a mechatronic installation component,
- a displacement component which is arranged above the mounting device and
- a support means which is at least indirectly fixed to the carrier component.

The displacement component displaces the mounting device in the elevator shaft by means of the support means. The carrier component is supported by means of an upper support roller on a support wall of the elevator shaft at least during a displacement in the elevator shaft. According to the invention, the support means has a diagonal pull with respect to the vertical in the direction of the support wall of the elevator shaft. In addition, the mounting system has a compensating element which, during a displacement of the carrier component in the elevator shaft, counteracts tilting of the carrier component about the upper support roller in the direction of the support wall.

The statements regarding the embodiments of the mounting system according to the invention can be transferred to said method accordingly.

Further advantages, features and details of the invention can be found in the following description of embodiments and with reference to the drawings, in which like or functionally like elements are provided with identical reference signs.

DETAILED DESCRIPTION

Figure 1:
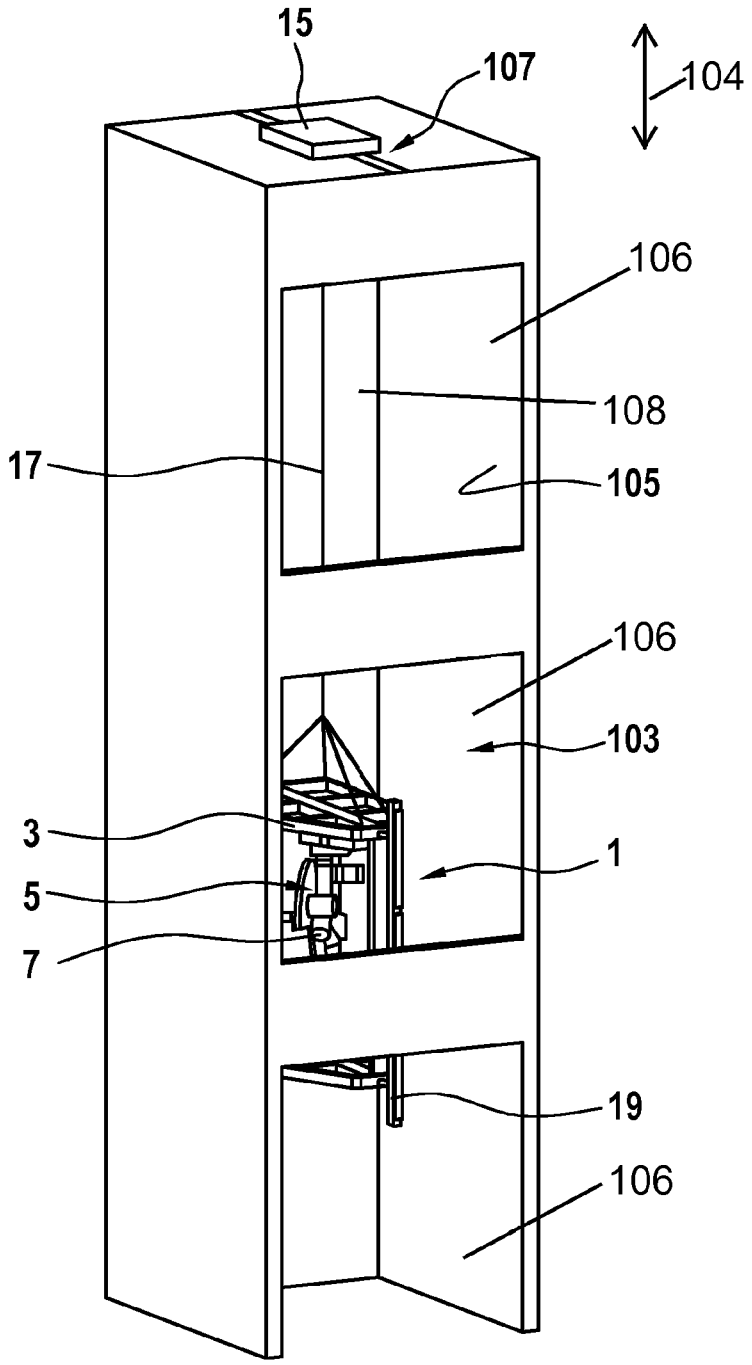
FIG. 1 is a perspective view of a mounting system for carrying out an installation operation in an elevator shaft of an elevator system in a functional state.
Figure 2:
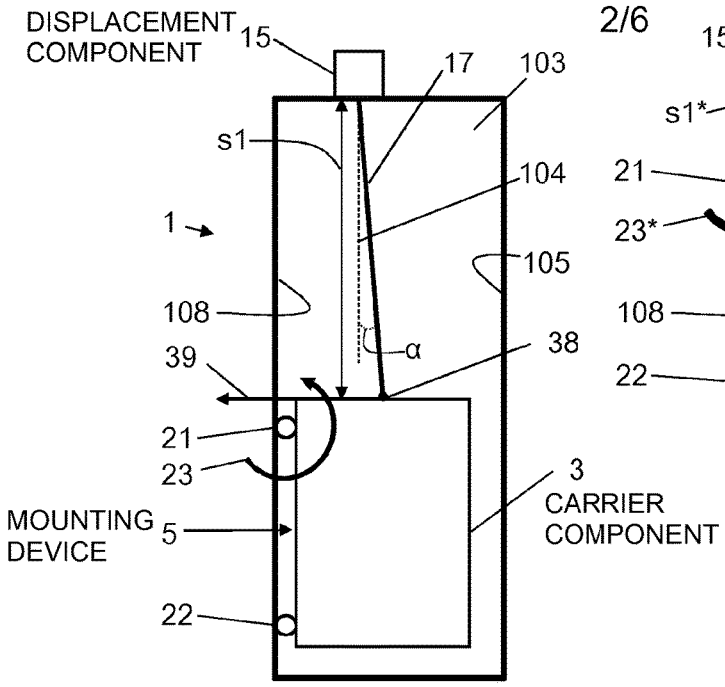
FIG. 2 is a side view of a mounting system without a compensating element prior to an upward displacement of a mounting device of the mounting system.

FIGS. 1 and 2 show a mounting system 1 without a compensating element which is designed and arranged such that, during a displacement of a carrier component 3 in the elevator shaft 103, it counteracts tilting of the carrier component 3 about the upper support roller 21 in the direction of (toward) a support wall 108. FIGS. 1 and 2 serve to explain the technical problem, which is solved by the combination of a diagonal pull of a support means with respect to the vertical in the direction of the support wall and a compensating element.

FIG. 1 shows an elevator shaft 103 of an elevator system in which a mounting system 1 is arranged. The mounting system 1 has a mounting device 5 comprising a carrier component 3 and a mechatronic installation component 7. The carrier component 3 is designed as a frame on which the mechatronic installation component 7 is mounted. Said frame has dimensions that allow the carrier component 3 to be displaced vertically inside the elevator shaft 103, thus along the vertical 104, i.e. to travel to different vertical positions on different floors within a building, for example. In the example shown, the mechatronic installation component 7 is in the form of an industrial robot that is attached to the frame of the carrier component 3 so as to be suspended downwardly. In this case, one arm of the industrial robot may be moved relative to the carrier component 3 and, for example, displaced toward or away from a shaft wall 105 of the elevator shaft 103.

The carrier component 3 is connected, by means of a steel cable acting as a support member or support means 17, to a displacement component 15 in the form of a motor-driven cable winch that is attached at the top of the elevator shaft 103 to a stopping point 107 on the ceiling of the elevator shaft 103. By means of the displacement component 15, the mounting device 5 can be vertically displaced inside the elevator shaft 103 over an entire length of the elevator shaft 103.

The mounting device 5 further comprises a fixing component 19 by means of which the carrier component 3 can be fixed inside the elevator shaft 103 in the lateral direction, i.e. in the horizontal direction. The fixing component 19 on the front side of the carrier component 3 and/or the prop (not shown) on a rear side of the carrier component 3 can be displaced outward to the front or the rear for this purpose, and thus press-fit the carrier component 3 between walls 105 of the elevator shaft 103.

The industrial robot can be coupled at its unsupported end to various mounting tools (not shown). The mounting tools can differ with regard to their design and their intended use. Said mounting tools allow mounting steps to be carried out semi-automatically or fully automatically in a fixed state of the mounting device.

A magazine component (not shown in more detail) may also be provided on the carrier component 3. The magazine component can be used to store components to be installed and to provide the industrial robot 7. The magazine component can accommodate for example various components, in particular in the form of different profiles, which are to be mounted on shaft walls 105 inside the elevator shaft 103, in order, for example, to be able to fasten guide rails for the elevator system thereto. The magazine component may also be used to store and provide screws, which can be screwed into prefabricated holes in the shaft wall 105 by means of the industrial robot 7.

Support rollers (not shown in FIG. 1) are also provided on the carrier component 3, by means of which rollers the carrier component 3 is guided during a vertical displacement inside the elevator shaft 103 along a shaft wall, which is referred to in the following as a support wall 108. The support wall 108 is, in this case, the shaft wall opposite the door openings 106 of the elevator shaft 103. The support rollers roll during the displacement of the mounting device 5 on the support wall 108. Depending on the arrangement of the support rollers on the carrier component, one to up to in particular four support rollers can be provided.

According to FIG. 2, the carrier component 3 has a pair of upper support rollers 21 and a pair of lower support rollers 22. The upper support rollers 21 are arranged in an upper region and the lower support rollers 22 in a lower region of the carrier component 3. In FIG. 2, the mounting device 5 is arranged in a lower region of the elevator shaft 103, therefore prior to an upward displacement. In this case, the carrier component 3 is at a first distance s1 from the displacement component 15. The support means 17, which is fixed directly to the carrier component 3 and by means of which the displacement component 15 can displace the mounting device 5 in the elevator shaft 103, has a pull $\alpha$ in the direction of the support wall 108. Said pull $\alpha$ corresponds to the angle enclosed by the support means 17 and the vertical 104 in the direction of the support wall 108. Due to the pull $\alpha$, a retaining force acting on the carrier component 3 via the support means 17 has a horizontal component 39 in the direction of the support wall 108. Since a force introduction point 38 at which the retaining force is introduced into the carrier component 3 is arranged above the upper support roller 21, in particular above a rotational axis (not indicated) of the upper support roller 21, the horizontal component 39 of the retaining force leads to a torque 23 in the counter-clockwise direction about the upper support roller 21. The force introduction point 38 is the point at which a suspension element (not shown in more detail), for example in the form of a hook or an eyelet, on which the support means 17 is suspended is fixed to the carrier component 3. The torque 23 is thus oriented such that, when of an appropriate magnitude, it can lead to lifting of the lower support rollers 22 and can thus lead to the carrier component 3 tilting about the upper support roller 21 in the direction of the support wall 108. The horizontal component of the retaining force in the direction of the support wall 108 ensures that at least the upper support rollers 21 do not lift off from the support wall 108 and thus the mounting device 5 cannot swing freely in the elevator shaft 103. Swinging of this kind can lead to the mounting device 5 striking one of the shaft walls 105 and to the mounting device 5 and the shaft wall 105 thus being damaged.

Figure 3:
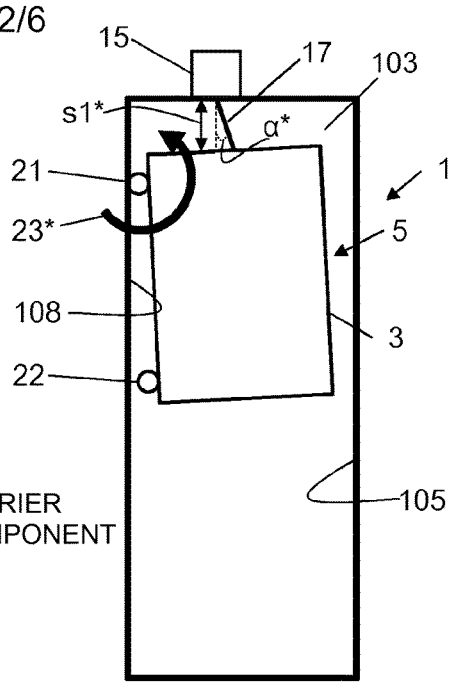
FIG. 3 is a side view of the mounting system from FIG. 2 after an upward displacement of the mounting device.

Compared with FIG. 2, the carrier component 3 in FIG. 3 is at a considerably shorter first distance s1* compared with the first distance s1 in FIG. 2, i.e. the mounting device 5 has been displaced upward in the elevator shaft 103 by the displacement component 15. Since the mounting system 1 in FIG. 2 and FIG. 3 does not have a compensating element and nothing has changed in terms of the connection between the displacement component 15, support means 17 and carrier component 3, the shorter distance s1* results in a significantly greater diagonal pull $\alpha^*$ of the support means 17 in the direction of the shaft wall 108. The greater diagonal pull $\alpha^*$ leads to a greater horizontal component of the retaining force in the direction of the support wall 108, and this leads to a significantly greater torque 23* about the upper support roller 21. In the example shown, the torque 23* is so great that the lower support rollers 22 lift off from the support wall 108 and the carrier component 3 tilts about the upper support roller 21 in the direction of the support wall 108. In the process, the mounting device 5 can strike the shaft wall 105, which can lead to the mounting device 5 and the shaft wall 105 being damaged.

Figure 4:
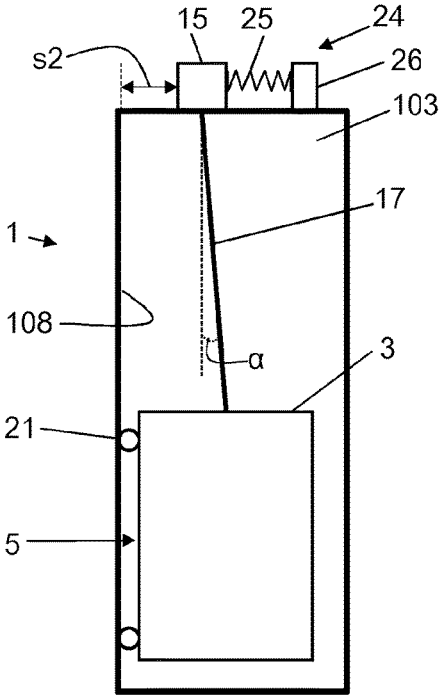
FIG. 4 is a side view of a mounting system with a compensating element in a first embodiment prior to an upward displacement of a mounting device of the mounting system.

The mounting system 1 according to FIG. 4 has a compensating element 24 which is designed and arranged such that, during a displacement of the carrier component 3 in the elevator shaft 103, it counteracts tilting of the carrier component 3 about the upper support roller 21 in the direction of the support wall 108. In FIG. 4, the mounting device 5 has the same position in the elevator shaft 103 as in FIG. 2. The compensating element 24 has an energy accumulator in the form of a spring 25. The spring 25 is arranged between a stationary support element 26 and the displacement component 15, which is designed in this case to be movable in a direction that is transverse with respect to the support wall 108. As described, on account of the pull $\alpha$ of the support means 17 a horizontal component of the retaining force acts on the carrier component 3, which has to be supported by the displacement component 15 in the opposite direction, i.e. against the spring 25. The spring 25 thus acts on the displacement component 15 with a retaining force in the direction perpendicular to the support wall 108. In FIG. 4, the displacement component 15 is at a second distance s2 from the support wall 108.

If the mounting device 5 is now displaced upward, the horizontal component of the retaining force on the carrier component 3 increases, and thus the force that has to be supported by the displacement component 15 against the spring 25 also increases. This leads to compression of the spring 25 and thus to a movement of the displacement component 15 away from the support wall 108. This movement of the displacement component 15 in turn counteracts the increase in the pull $\alpha$ of the support means 17 in the direction of the support wall 108. In the process, an equilibrium is constantly set which is determined mainly by the characteristic of the spring 25. By calculations or simple experiments, the spring 25 can be designed such that tilting of the mounting device 5 can be reliably avoided.

Figure 5:
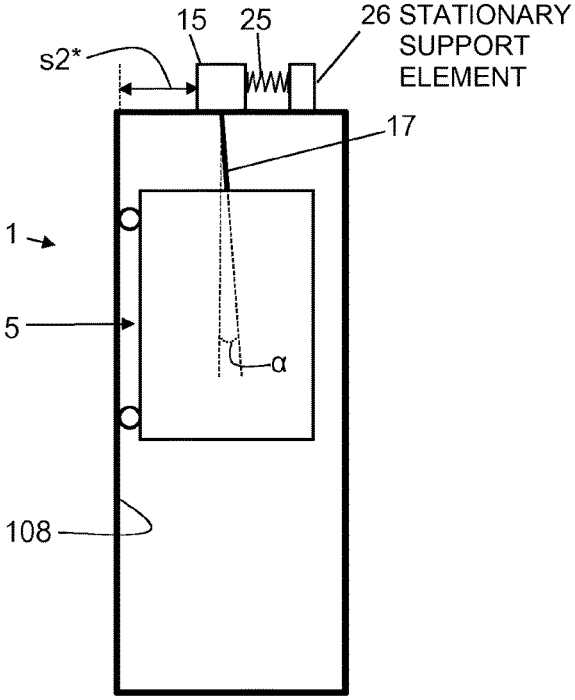
FIG. 5 is a side view of the mounting system from FIG. 4 after an upward displacement of the mounting device.

FIG. 5 shows the mounting system 1 from FIG. 4 after completion of the upward displacement of the mounting device 5. The pull $\alpha$ of the support means 17 in the direction of the support wall 108 is approximately the same as in the position of the mounting device 5 in FIG. 4, and thus much weaker than the diagonal pull $\alpha^*$ in FIG. 3, i.e. without the use of a compensating element. This was achieved by a movement of the displacement component 15 in the transverse direction away from the support wall 108 and thus by compressing the spring 25. In FIG. 5, the displacement component 15 is at a second distance s2* from the support wall 108, which distance is significantly greater than the second distance s2 in FIG. 4.

Figure 6:
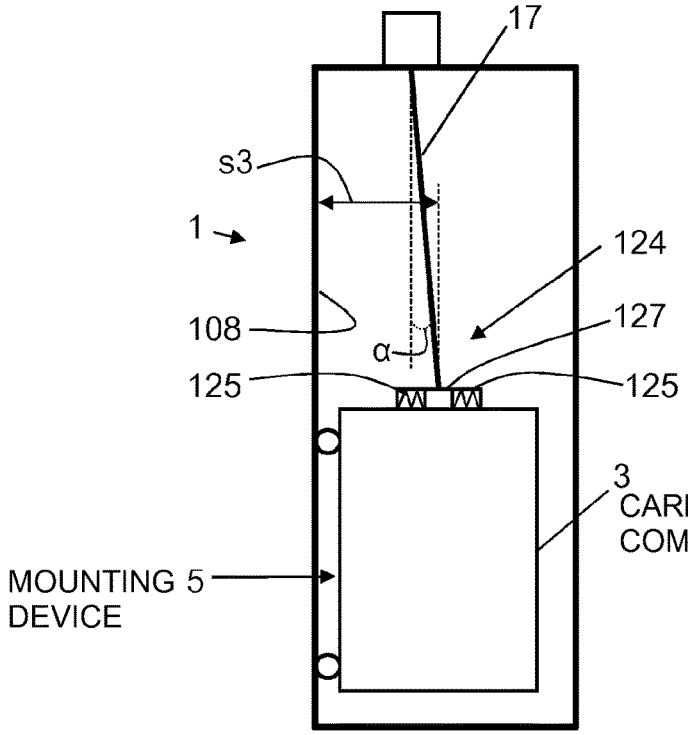
FIG. 6 is a side view of a mounting system with a compensating element in a second embodiment prior to an upward displacement of a mounting device of the mounting system.

In the mounting system 1 according to FIG. 6, a compensating element 124 is arranged on top of the carrier component 3. The support means 17 is fixed to the carrier component 3 by means of a suspension element 127 that is movable in the direction perpendicular to the support wall 108. The compensating element 124 has two springs 125 which are arranged on opposite sides of the suspension element 127 with respect to the support wall 108 and thus each exert a retaining force on the suspension element 127. The ends of the springs 125 opposite the suspension element 127 are fixed in position with respect to the carrier component 3 in a manner not shown in more detail. In FIG. 6, the suspension element 127 is at a third distance s3 from the support wall 108.

If the mounting device 5 is now displaced upward, the horizontal component of the retaining force on the carrier component 3 increases and the suspension element 127 is pressed in the direction of the support wall 108 and displaced against the force of the springs 125 in the direction of the support wall 108. This movement of the suspension element 127 in turn counteracts the increase in the diagonal pull $\alpha$ of the support means 17 in the direction of the support wall 108. In the process, an equilibrium is constantly set which is determined mainly by the characteristic of the springs 125. By calculations or simple experiments, the springs 125 can be designed such that tilting of the mounting device 5 can be reliably avoided.

Figure 7:
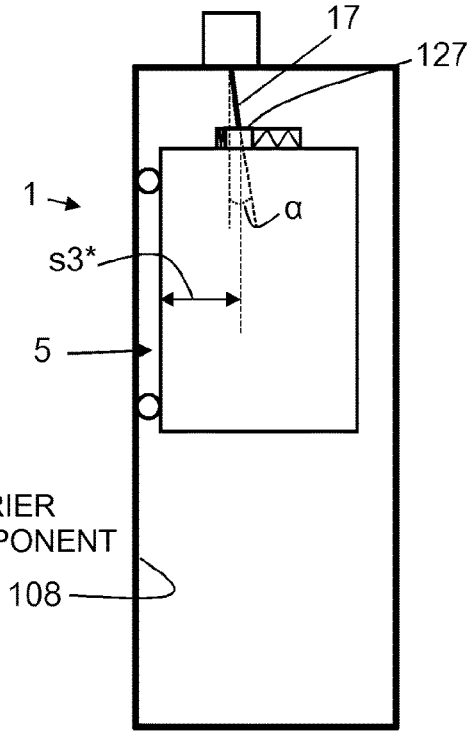
FIG. 7 is a side view of the mounting system from FIG. 6 after an upward displacement of the mounting device.

FIG. 7 shows the mounting system 1 from FIG. 6 after completion of the upward displacement of the mounting device 5. The pull $\alpha$ of the support means 17 in the direction of the support wall 108 is approximately the same as in the position of the mounting device 5 in FIG. 6, and thus much weaker than the diagonal pull $\alpha^*$ in FIG. 3, i.e. without the use of a compensating element. This was achieved by a movement of the suspension element 127 in the direction perpendicular to the support wall 108. In FIG. 7, the suspension element 127 is at a third distance s3* from the support wall 108, which is significantly shorter than the third distance s3 in FIG. 6.

Figure 8:
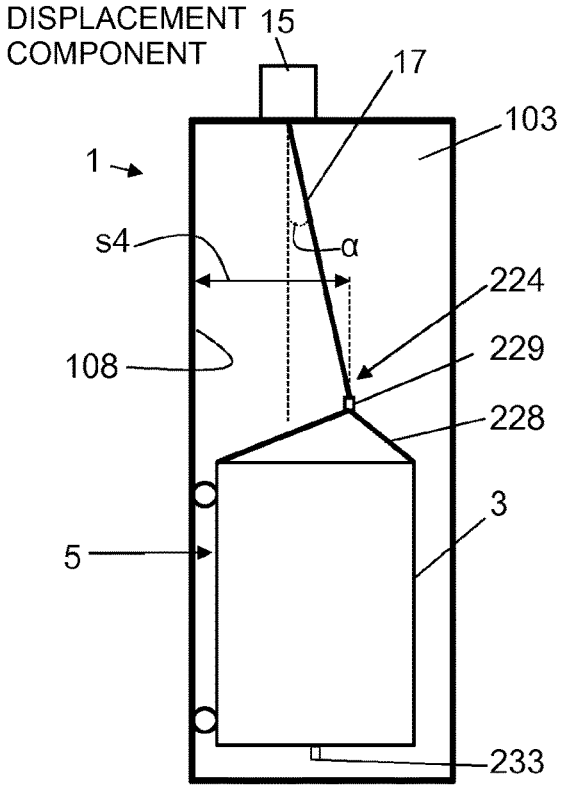
FIG. 8 is a side view of a mounting system with a compensating element in a third embodiment prior to an upward displacement of a mounting device of the mounting system.
Figure 10:
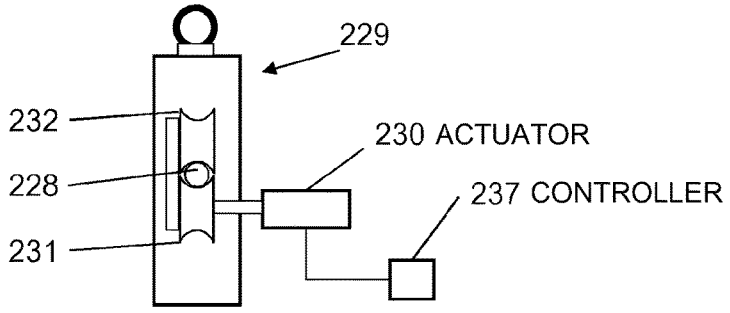
FIG. 10 is a more detailed view of the compensating element in the third embodiment.

In the mounting system 1 according to FIG. 8, a suspension means 228 is arranged between the support means 17 and the carrier component 3, the support means 17 and the suspension means 228 being connected by means of a connecting element 229. The suspension means 228 is designed as a cable loop of which the ends are connected to the carrier component 3 on opposite sides with respect to the support wall 108. A compensating element 224 is arranged on the suspension means 228 and is designed to be able to move the connecting element 229 relative to the suspension means 228. For this purpose, the compensating element 224 has an actuator 230 (shown only in FIG. 10) in the form of an electric motor, by means of which the connecting element 229 can be moved relative to the suspension means 228. The actuator 230 can drive a drive roller 231. The suspension means 228 extends between the drive roller 231 and a press roller 232. The press roller 232 is pressed by means of a spring (not shown) against the suspension means 228, which is thus pressed against the drive roller 231. If the actuator 230 now drives the drive roller 231, said roller rolls on the suspension means 228, as a result of which the position of the connecting element 229 with respect to the suspension means 228 and thus a fourth distance s4 from the support wall 108 can be set.

The actuator 230 is actuated by a controller 237. The controller 237 sets said fourth distance on the basis of an inclination of the carrier component 3. An inclination sensor 233 is arranged at the bottom of the carrier component 3 in order to measure the inclination. The controller 237 measures the inclination and sets the fourth distance by means of closed-loop control such that the carrier component 3 is always oriented vertically, i.e. is not inclined. It is also possible for the controller 237 to set said fourth distance on the basis of the first distance between the displacement component 15 and the mounting device 5. For this purpose, the controller 237 can directly measure the first distance by means of a distance sensor (not shown). It is also possible for the controller to measure a distance from a bottom of the elevator shaft 103 and to determine the first distance therefrom. Moreover, it is possible for the controller 237 to detect how far the displacement component 15 displaces the mounting device 5 in the elevator shaft 103 and to determine the current first distance proceeding from a first distance prior to the displacement. To determine the currently required fourth distance, a table is stored in the controller 237, in which table the fourth distance is stored on the basis of the first distance. When the controller 237 has determined the current first distance, it can read out the currently required fourth distance from said table, and then set this using the actuator 230.

Figure 9:
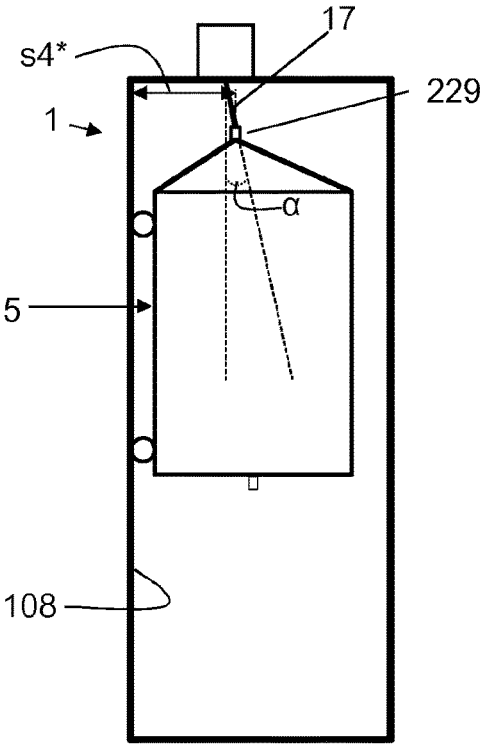
FIG. 9 is a side view of the mounting system from FIG. 8 after an upward displacement of the mounting device.

In FIG. 8, the connecting element 229 is at a fourth distance s4 from the support wall 108. FIG. 9 shows the mounting system 1 from FIG. 8 after completion of the upward displacement of the mounting device 5. The pull $\alpha$ of the support means 17 in the direction of the support wall 108 is approximately the same as in the position of the mounting device 5 in FIG. 8, and thus much weaker than the diagonal pull $\alpha^*$ in FIG. 3, i.e. without the use of a compensating element. This was achieved by a movement of the connecting element 229 by means of the actuator 230 in the direction perpendicular to the support wall 108. In FIG. 9, the connecting element 229 is at a fourth distance s4* from the support wall 108, which is significantly shorter than the fourth distance s4 in FIG. 8.

Figure 11:
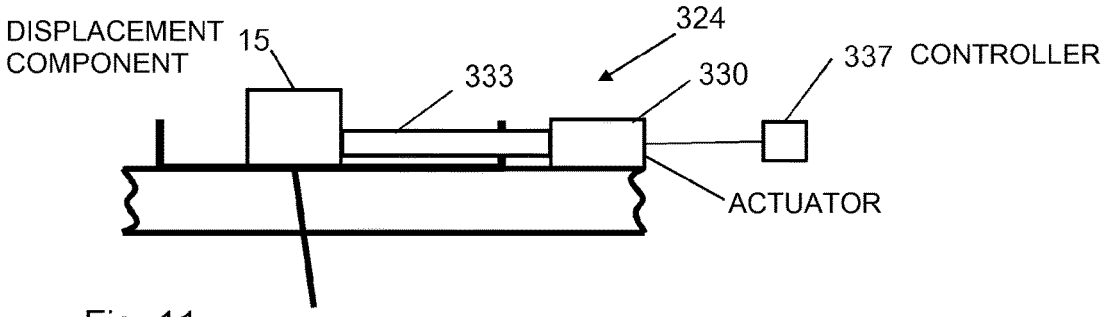
FIG. 11 shows a compensating element in a fourth embodiment.

FIG. 11 shows a compensating element 324 that is an alternative to the compensating element 24 from FIGS. 4 and 5. The compensating element 324 has an actuator 330 instead of a spring, by means of which actuator the displacement component 15 can be moved. The actuator 330 is designed as an electric motor which can extend and retract an actuating cylinder 333 acting on the displacement component 15. The actuator 330 is actuated analogously to the actuator 230 from FIG. 10 by a controller 337.

Figure 12:
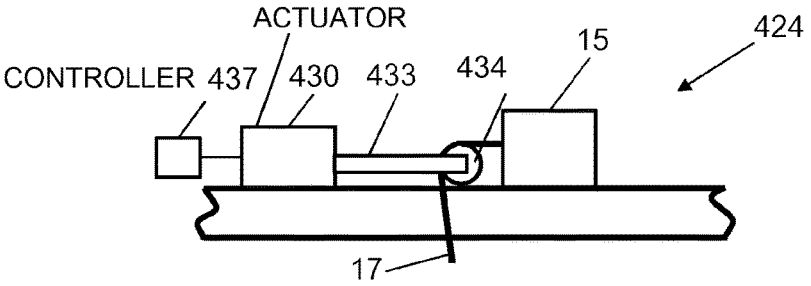
FIG. 12 shows a compensating element in a fifth embodiment.

FIG. 12 shows a further compensating element 424 that is an alternative to the compensating element 24 from FIGS. 4 and 5. The compensating element 424 also has an actuator 430, by means of which a deflection element 434 in the form of a deflection roller can be moved in a direction perpendicular to the support wall 108. The displacement component 15 is in this case stationary and arranged such that the support means 17 is guided horizontally out of the displacement component 15 and is then deflected downward by means of the deflection element 434. Moving the deflecting element 434 has the same effect as moving the displacement component 15 in FIG. 11. The actuator 430 is designed as an electric motor which can extend and retract an actuating cylinder 433 acting on the deflection element 434. The actuator 430 is controlled analogously to the actuator 230 from FIG. 10 by a controller 437.

The deflection element in the form of a deflection roller could also be acted on, analogously to the displacement component in FIGS. 4 and 5, with a retaining force by means of one or two energy accumulators, in particular in the form of springs. In this case, the actuator and the controller could be omitted.

Figure 13:
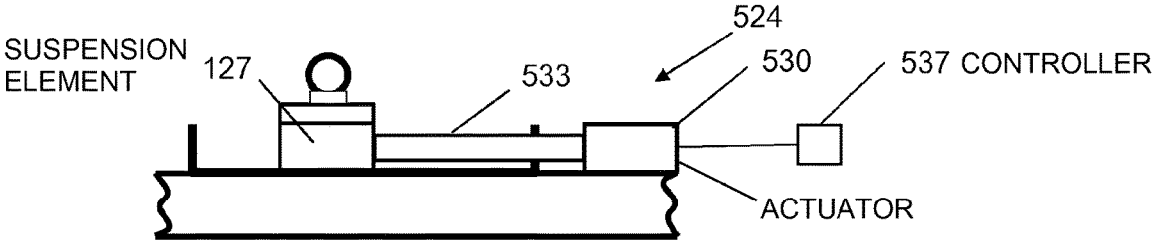
FIG. 13 shows a compensating element in a sixth embodiment.

FIG. 13 shows a compensating element 524 that is an alternative to the compensating element 124 from FIGS. 6 and 7. The compensating element 524 has an actuator 530 instead of a spring, by means of which actuator the suspension element 127 can be moved. The actuator 530 is designed as an electric motor which can extend and retract an actuating cylinder 533 acting on the suspension element 127. The actuator 530 is controlled analogously to the actuator 230 from FIG. 10 by a controller 537.

The described controllers 237, 337, 437, 537 which actuate the actuators 230, 330, 430, 530 are designed in particular such that they actuate said actuators 230, 330, 430, 530 when the mounting device 5 is fixed in the elevator shaft 103 by means of the fixing component 19.

Figure 14:
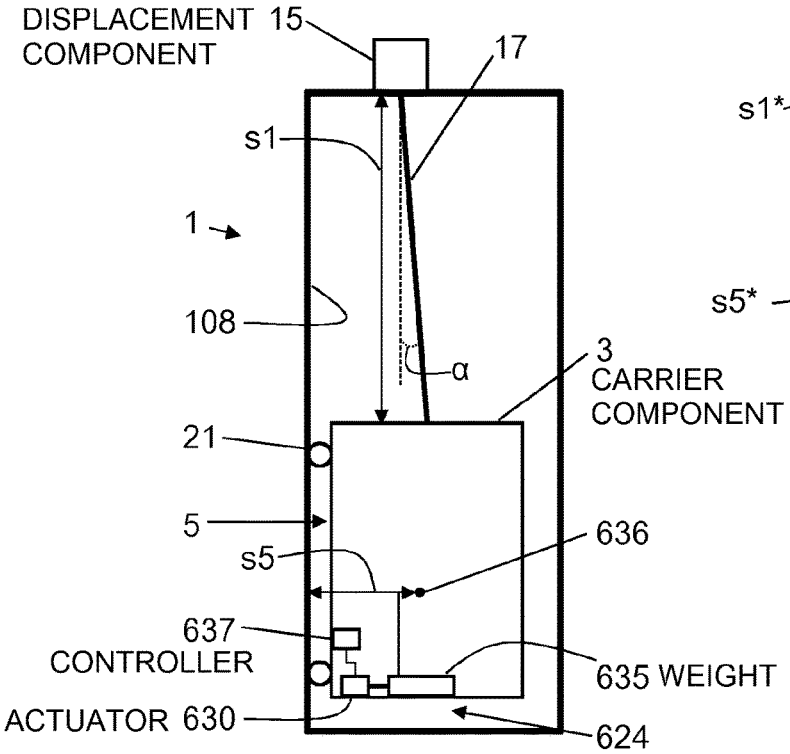
FIG. 14 is a side view of a mounting system with a compensating element in a seventh embodiment prior to an upward displacement of a mounting device of the mounting system.
Figure 15:
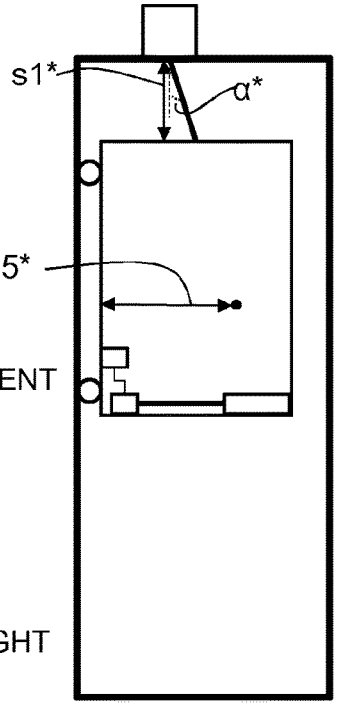
FIG. 15 is a side view of the mounting system from FIG. 14 after an upward displacement of the mounting device.

The mounting system 1 according to FIGS. 14 and 15 has a very similar design to the mounting system 1 according to FIGS. 2 and 3, and therefore only the differences are discussed. The mounting system 1 according to FIGS. 14 and 15 also does not involve a change in terms of the connection between the displacement component 15, support means 17 and carrier component 3, and therefore in FIG. 15 a shorter distance s1* results in a significantly greater diagonal pull $\alpha^*$ of the support means 17 in the direction of the shaft wall 108. In order to prevent tilting of the carrier component 3 about the upper support roller 21 in the direction of the support wall 108, the mounting system 1 has a compensating element 624. The compensating element 624 has an actuator 630 which is connected to a compensating weight 635. The compensating weight 635 can be moved relative to the carrier component 3 mainly in the horizontal direction by means of the actuator 630. Due to the movement of the compensating weight 635, a center of gravity 636 of the mounting device 5 can be moved and thus a fifth distance between the center of gravity 636 and the support wall 108 can be changed or set. The actuator 630 is actuated by a controller 637 such that the fifth distance between the center of gravity 636 of the mounting device 5 and the support wall 108 is increased when a first distance between the displacement component 15 and the mounting device 5 reduces. The actuator 630 is actuated analogously to the actuator 230.

FIG. 14 shows the mounting system 1 prior to an upward displacement. The center of gravity 636 of the mounting device 5 is at a fifth distance s5 from the support wall 108. After the upward displacement of the mounting system 1 in FIG. 15, the fifth distance s5* is significantly greater.

Figure 16:
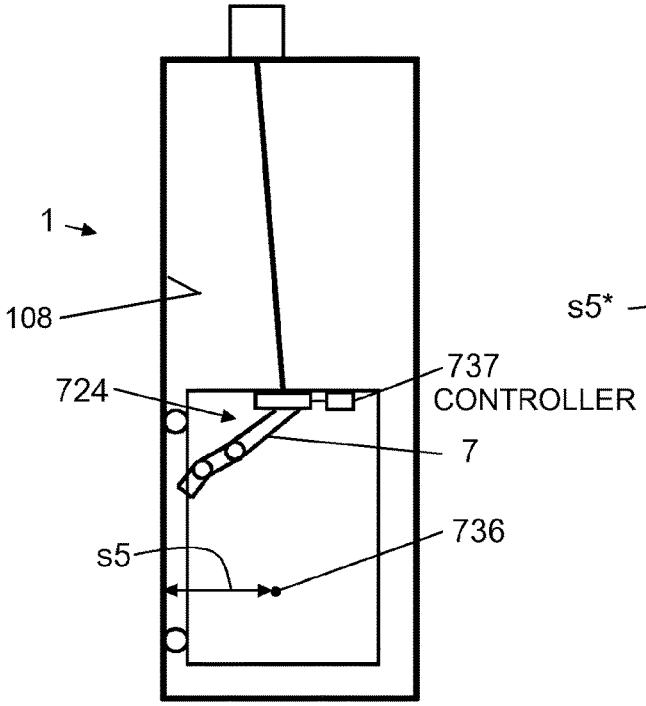
FIG. 16 is a side view of a mounting system with a compensating element in an eighth embodiment prior to an upward displacement of a mounting device of the mounting system.
Figure 17:
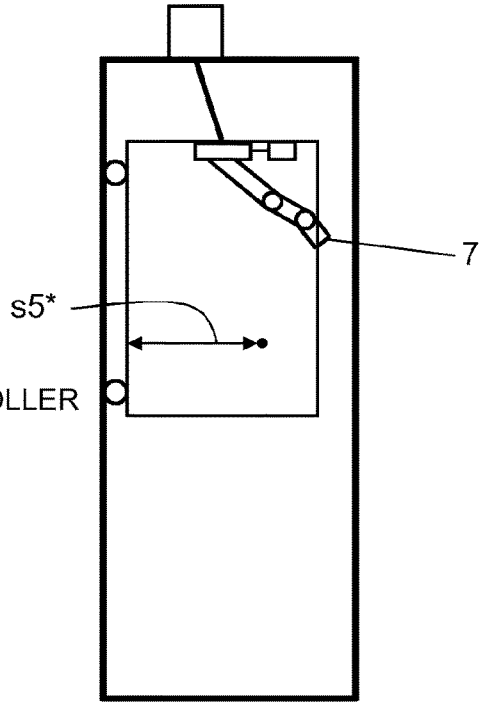
FIG. 17 is a side view of the mounting system from FIG. 16 after an upward displacement of the mounting device.

The mounting system 1 according to FIGS. 16 and 17 has a compensating element 724 which in principle functions in the same way as the compensating element 624 from FIGS. 13 and 14. The difference is that in the mounting system 1 according to FIGS. 16 and 17, the mechatronic installation component 7 in the form of the industrial robot is part of the compensating element 724 and is used as a compensating weight. The center of gravity 736 is in this case moved by a change in the position of the mechanical installation component 7, i.e. by means of a change in the position of the mechatronic installation component 7. FIG. 16 shows the mounting system 1 prior to an upward displacement. The mechatronic installation component 7 is arranged as close as possible to the support wall 108, resulting in a fifth distance s5 between the center of gravity 736 of the mounting device 5 and the support wall 108. During the upward displacement of the mounting system 1, the position of the mechatronic installation component 7 is continuously changed by a corresponding actuation by a controller 737 such that it is at an ever greater distance from the support wall 108. After completion of the upward displacement of the mounting system 1 in FIG. 17, the fifth distance s5* is significantly greater.

Figure 18:
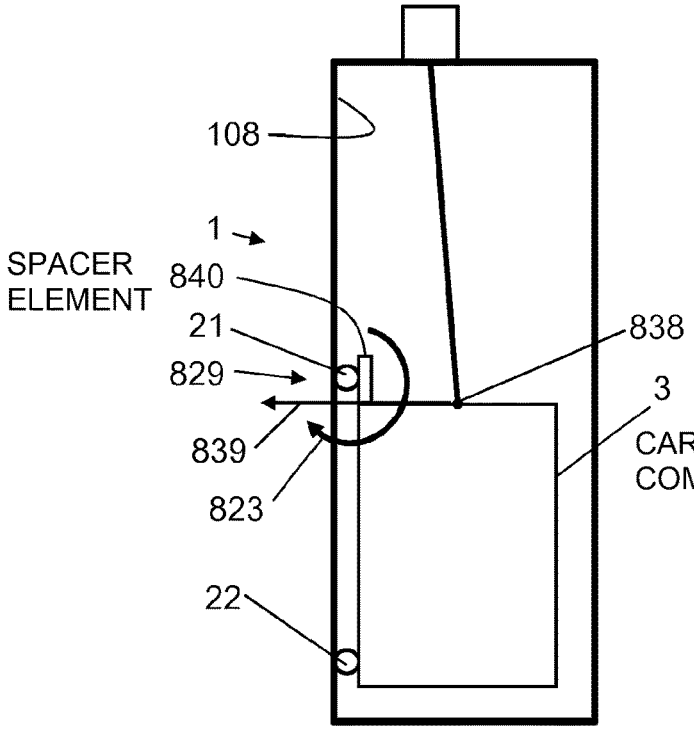
FIG. 18 is a side view of a mounting system with a specific arrangement of a force introduction point with respect to an upper support roller prior to an upward displacement of a mounting device of the mounting system and FIG. 19 is a side view of the mounting system from FIG. 18 after an upward displacement of the mounting device.
Figure 19:
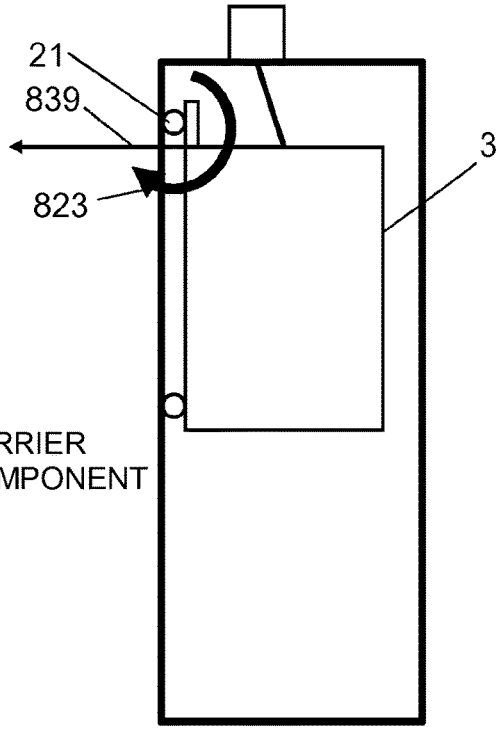

In the mounting system 1 according to FIGS. 18 and 19, the upper support roller 21 is arranged on a spacer element 840 that projects upward from the carrier component 3. A force introduction point 838 at which the retaining force is introduced into the carrier component 3, is therefore arranged below the upper support roller 21, in particular below a rotational axis (not indicated) of the upper support roller 21. It would also be possible for the force introduction point to be arranged at the same level as the upper support roller. The horizontal component 839 of the retaining force thus extends below the support roller 21, resulting in a torque 823 about the upper support roller 21 which is in the opposite direction to the torque 23 in FIG. 2. The torque 823 cannot therefore lead to the lower support roller 22 lifting off from the support wall 108 and thus to the carrier component 3 tilting about the upper support roller 21; rather, the lower support roller 22 is pressed against the support wall 108 on account of the torque 823. The upper support roller 21, the spacer element 840 and the force introduction point 838 thus form a compensating element 829 which, during the displacement of the carrier component 3 in the elevator shaft 103, counteracts the tilting of the carrier component 3 about the upper support roller 21 in the direction of the support wall 108. In addition to the components mentioned, the compensating element may also comprise a suspension element (not shown), for example in the form of an eyelet, a hook or a through-opening of the carrier component.

As can be seen in FIG. 19, an upward displacement of the carrier component 3 does not change the arrangement of the horizontal component 839 of the retaining force on the support roller 21, which component is greater compared with FIG. 18. As a result, the orientation of the torque 823 about the upper support roller also remains unchanged, and therefore there is also no tilting of the carrier component 3 in the direction of the support wall 108 during or after an upward displacement of the carrier component 3.

Finally, it should be noted that terms such as "comprising", "having", etc. do not preclude other elements or steps, and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A mounting system for carrying out an installation operation in an elevator shaft of an elevator system comprising:

a mounting device positioned in the elevator shaft and having a carrier component and a mechatronic installation component mounted on the carrier component;

a displacement component arranged above the mounting device;

a support member connected between the displacement component and the carrier component, wherein the displacement component displaces the mounting device in a vertical direction in the elevator shaft using the support member, wherein the carrier component is supported by an upper support roller on a support wall of the elevator shaft at least during a displacement of the mounting device in the elevator shaft, the upper support roller being arranged in an upper region of the carrier component and wherein the support member exerts a diagonal pull with respect to the vertical direction toward the support wall; and a compensating element adapted to, during the displacement of the mounting device in the elevator shaft, counteract tilting of the carrier component about the upper support roller toward the support wall, the tilting being caused by the diagonal pull.

2. The mounting system according to claim 1 wherein the compensating element counteracts an increase in the diagonal pull when a first distance between the displacement component and the mounting device reduces during the displacement of the mounting device.

3. The mounting system according to claim 2 wherein the compensating element is arranged with the displacement component and increases a second distance between the support member in a region of the displacement component and the support wall when the first distance between the displacement component and the mounting device reduces.

4. The mounting system according to claim 3 wherein the displacement component is movable in a direction perpendicular to the support wall.

5. The mounting system according to claim 4 wherein, in a region of the displacement component, a deflection element is arranged and guides the support member, the deflection element being movable in a direction perpendicular to the support wall.

6. The mounting system according to claim 2 wherein the compensating element is arranged on the carrier component and reduces a distance between a suspension element of the carrier component, the suspension element connecting the carrier component to the support member, and the support wall when the first distance between the displacement component and the mounting device reduces.

7. The mounting system according to claim 6 wherein the suspension element is movable in a direction perpendicular to the support wall.

8. The mounting system according to claim 6 wherein the compensating element has at least one energy accumulator that acts on the suspension element with a force in a direction perpendicular to the support wall.

9. The mounting system according to claim 2 including a suspension means arranged between the support member and the carrier component, the support means and the suspension member being connected by a connecting element, and wherein the compensating element reduces a distance between the connecting element and the support wall when the first distance between the displacement component and the mounting device reduces.

10. The mounting system according to claim 2 wherein the compensating element is arranged with the displacement component and increases a second distance between the support member in a region of the displacement component and the support wall when the first distance between the displacement component and the mounting device reduces, wherein the compensating element has at least one energy accumulator that acts on the displacement component with a force in a direction perpendicular to the support wall.

11. The mounting system according to claim 2 wherein the compensating element has at least one actuator that displaces, in a direction perpendicular to the support wall, the displacement component, a deflection element engaging the support member, a suspension element fixing the support member to the carrier component or a connecting element connecting the support member through a suspension means to the carrier component.

12. The mounting system according to claim 2 wherein the compensating element increases a distance between a center of gravity of the mounting device and the support wall when the first distance between the displacement component and the mounting device reduces.

13. The mounting system according to claim 12 wherein the compensating element has a compensating weight and an actuator, and wherein the compensating weight is moved by the actuator.

14. The mounting system according to claim 12 wherein the compensating element includes the mechatronic installation component and the distance is increased by changing a position of the mechatronic installation component relative to the carrier component.

15. The mounting system according to claim 1 wherein the compensating element has a force introduction point at which a retaining force is introduced into the carrier component, the force introduction point being arranged at a same level as or below the upper support roller.

16. A method for carrying out an installation operation in an elevator shaft of an elevator system using a mounting system according to claim 1, the method comprising the steps of:

positioning the mounting device in the elevator shaft;

arranging the displacement component above the mounting device;

connecting the support member between the displacement component and the carrier component;

providing the compensating element;

operating the displacement component to displace the mounting device in a vertical direction in the elevator shaft using the support member, wherein the carrier component is supported by the upper support roller on the support wall of the elevator shaft during the displacement, and wherein the support means exerts a diagonal pull with respect to the vertical direction toward the support wall; and wherein the compensating element, during the displacement of the mounting device in the elevator shaft, counteracts tilting of the carrier component about the upper support roller toward the support wall caused by the diagonal pull.

17. A mounting system for carrying out an installation operation in an elevator shaft of an elevator system comprising:

a mounting device positioned in the elevator shaft and having a carrier component and a mechatronic installation component mounted on the carrier component;

a displacement component arranged above the mounting device;

a support member connected between the displacement component and the carrier component, wherein the displacement component displaces the mounting device in a vertical direction in the elevator shaft using the support member, wherein the carrier component is supported by an upper support roller on a support wall of the elevator shaft at least during a displacement of the mounting device in the elevator shaft, and wherein the support member exerts a diagonal pull with respect to the vertical direction toward the support wall;

a compensating element adapted to, during the displacement of the mounting device in the elevator shaft, counteract tilting of the carrier component about the upper support roller toward the support wall caused by the diagonal pull;

wherein the compensating element counteracts an increase in the diagonal pull when a first distance between the displacement component and the mounting device reduces during the displacement of the mounting device; and wherein the compensating element is arranged on the carrier component and reduces a distance between a suspension element of the carrier component, the suspension element connecting the carrier component to the support member, and the support wall when the first distance between the displacement component and the mounting device reduces.

* * * * *